US005529302A

United States Patent [19]

Rodriguez

[11] Patent Number: 5,529,302

[45] Date of Patent: Jun. 25, 1996

[54] GOLF PUTTER AND METHOD

[76] Inventor: Moctezuma Rodriguez, 10210 Trading Post Dr., Houston, Tex. 77064

[21] Appl. No.: 435,712

[22] Filed: May 5, 1995

[51] Int. Cl.[6] ..... A63B 53/04

[52] U.S. Cl. ..... 473/251; 473/328; 473/334; 473/340

[58] Field of Search ..... 273/167 C, 167 B, 273/164.1, 167 A, 167 E, 192, 186.2, 187.4; D21/219

[56] References Cited

U.S. PATENT DOCUMENTS

| | | | |
|---|---|---|---|
| 823,082 | 6/1906 | Robertson | 273/167 C |
| 1,531,821 | 3/1925 | Scott | 273/164.1 X |
| 3,104,108 | 9/1963 | Robertson | 273/192 |
| 3,656,752 | 4/1972 | Moriarty | 273/192 X |
| 3,873,094 | 3/1975 | Sebo et al. | 273/163 R |
| 3,888,484 | 6/1975 | Zitko | 273/164.1 X |
| 3,942,802 | 3/1976 | Wright | 273/192 X |
| 4,034,989 | 7/1977 | Stewart | 273/164 |
| 4,629,193 | 12/1986 | Pierman | 273/164 |
| 4,679,792 | 7/1987 | Straza et al. | 273/78 |
| 4,693,478 | 9/1987 | Long | 273/164 |
| 4,795,158 | 1/1989 | Kuykendall | 273/164 |
| 4,805,583 | 2/1989 | Mosser | 273/162 R |
| 4,962,931 | 10/1990 | Jazdzyk | 273/164 |
| 5,022,656 | 6/1991 | Tiller | 273/191 B |
| 5,080,365 | 1/1992 | Winchell | 273/167 C X |
| 5,294,122 | 3/1994 | Longo | 273/167 B X |
| 5,344,151 | 9/1994 | Anderson et al. | 273/164.1 X |

*Primary Examiner*—George J. Marlo
*Attorney, Agent, or Firm*—Kenneth L. Nash

[57] ABSTRACT

A putting apparatus and method are disclosed which provide for an elongate sighting member disposed directly behind a striking face that has a diameter about the same as that of a golf ball. The elongate sighting member is oriented in the direction of the hole. A fin member extends radially outwardly from the body of the elongate sighting member. The fin member is designed for engagement with the surface of the putting green and is spaced so that it places the striking face at the desired vertical orientation so as to impart overspin on the ball.

19 Claims, 4 Drawing Sheets

14
14
14
10
10
10
12
12
12

60
16
56
20
22
52
22
40
50
40
18
40
42

GOLF PUTTER AND METHOD

BACKGROUND OF THE INVENTION

1. Field of the Invention

The present invention relates generally to golf putters and, more particularly, to apparatus and methods for increased putting accuracy and consistency.

2. Description of the Background

Each day a large number of avid golfers gather to play golf on numerous golf courses throughout most of the world. The game of golf is very challenging and each golfer continually strives to improve his game. While there are many techniques involved in the game of golf besides those of the putting game, it can probably safely be said that increased accuracy and consistency at putting is a goal of practically all golfers.

The accuracy and consistency of a putt is dependent on the precise movement and orientation of the putter as the golf ball is hit. As a general rule, the golf putter includes a shaft portion having a putter head on one end thereof. The putter head has a striking surface for hitting the ball. Numerous attempts have been made to design a putter or training device for a putter that improves the user's accuracy and consistency. Aspects that are particularly important to putting include: (1) accurate aiming, (2) moving of the putter in the desired direction of aiming, and (3) hitting the ball at a position so as to impart an overspin to roll the ball forward rather than imparting a sliding movement thereto.

U.S. Pat. No. 5,022,656 to R. Tiller discloses a training device having a long, slender rigid bar attached to the shaft of a putter. A resilient, flexible line is attached to the bar. The line has one end adapted to be anchored to a stationary point.

U.S. Pat. No. 5,344,151 to Anderson et at. discloses a golf putter head that utilizes a cylindrical weight receptacle centrally located and perpendicular to the rear of the location on the striking surface where the golf ball is intended to be struck.

U.S. Pat. No. 4,795,158 to J. E. Kuykendall discloses a golf putter comprising a putter blade having a forwardly-angled striking face to impart immediate overspin to the ball being struck. The putter further includes a relatively large square handle or grip for enabling alignment of the palm of the hand with the projected line of ball travel.

U.S. Pat. No. 4,962,931 to M. Jazdzyk, Jr. discloses a golf putter with a head portion having an upwardly extending hose to which a shaft is secured. The head of the putter has an upper surface with a camouflaging texture that simulates the color and texture of the grass covering the putting green. With this camouflaging, highly visible indicia on the club head and spaced parallel fins equaling the diameter of the ball stand out so that the golfer can square the putter face with the putting line.

U.S. Pat. No. 4,679,792 to Straza et al. discloses a golf putter head with a cavity in its front face containing an insert member having a front, ball striking face co-planar with the front face of the body. The insert member comprises a honeycomb cellular structure with the cells of the structure filled with a resilient, epoxy material. The walls of the cellular structure are mounted in the cavity perpendicular to the inclined club striking face surface and have exposed cell edges co-planer with the surface of the resilient material and the club striking surface for simultaneously impacting a golf ball.

U.S. Pat. No. 4,693,478 to D. C. Long discloses a golf putter head that is longer, wider, and higher. The putter head includes a blade having a striking face, a blade sole, a heel end, a toe end and a rear face. A flange extends integrally and rearwardly from the blade and has enlarged heel and toe sections. The putter head has a milled face smoothed to within 0.001 inch to eliminate skew on striking.

U.S. Pat. No. 3,873,094 to Sebo et al. discloses a golf club head formed of light-transmitting material and having at least one and preferably three metallic weight members, preferably elongate, disposed transversely to the longitudinal axis of the club head.

U.S. Pat. No. 4,034,989 to A. P. Stewart discloses a golf putter having a pair of horizontally spaced sights on the back face of the club head, with the sights diverging outwardly and rearwardly, the arrangement being such that the forward projection of the sights converges at a point spaced several feet in front of the putter.

U.S. Pat. No. 4,629,193 to M. J. Pierman discloses a golf putter head with an elongate side-to-side extending body portion with a front face adapted to be positioned in a generally vertically extending plane. A forward upper face has a short notch extending along an axis which is referred to as the X axis and is perpendicular to the front face. Notches extend on either side of the short notch extending along the line defined as a Y axis which is parallel to the plane containing the front face and which is perpendicular to the X axis.

U.S. Pat. No. 3,942,802 to G. C. Wright discloses a golfing aid for improving a golfer's swing plane and putting stroke that includes a base member with an elongated rod connected to the base member by a pivotal support arm wherein the elongated rod is movable between a first position wherein it inclines upwardly and outwardly away from the golfer in a forward direction and a second position wherein it lies parallel to the ground in closely spaced relationship therewith.

U.S. Pat. No. 3,656,752 to F. T. Moriarty discloses a training aid for putting having a base adapted to assume the slope of the surface on which it is placed and a standard normal to the base and providing a line of travel sighting aid.

Consequently, there remains a need for a golf putter that allows for accurate and consistent putting by providing easier sighting and providing means for consistently hitting the ball at a position that imparts an overspin thereto. Those skilled in the art have long sought and will appreciate the present invention which provides solutions to these and other problems.

SUMMARY OF THE INVENTION

The present invention provides for a golf putter having a shaft with a hand grip end and a golf head end opposite the hand grip end. An elongate golf head is disposed at the golf head end of the shaft, the elongate golf head has a first end and a second end and a body section with a body axis between the first and second ends. The first end has a striking surface thereon substantially transverse to the body axis. A fin member is disposed on a side portion of the body section and extends radially outwardly from the body section. The fin has a planar surface substantially parallel to the body axis. The elongate golf head has an elongate sighting member disposed between the first and second ends ranging from about three to about twenty inches long.

In operation, the putter is positioned with the putter striking face adjacent the golf ball. The elongate sighting member is pointed in a desired direction for putting the golf ball. A vertical spacing member is slidingly moved along a ground surface disposed directly behind the golf ball in line with the elongate sighting member. The vertically spacing member is sized to space the putter striking face at a vertical position for imparting overspin to the ball with the striking face. The golf ball is hit with the putter striking face.

It is an object of the present invention to provide an improved putting apparatus and method.

It is another object of the present invention to provide a golf putter with a simple but highly accurate sighting means.

It is yet another object of the present invention to provide a golf putter with a consistent manner of striking the golf ball to provide overspin.

A feature of the present invention is an elongate sighting member disposed opposite a relatively small striking face.

Another feature of the present invention is a golf putter with a fin member that guides movement of the putter and also vertically aligns the striking face with respect to the ball to consistently provide an overspin.

An advantage of the present invention is an easily useable golf putter for improving critical elements of the putting game.

These and other objects, features, and advantages of the present invention will become apparent from the drawings, the descriptions given herein, and the appended claims.

Figures 1, 3, 4:
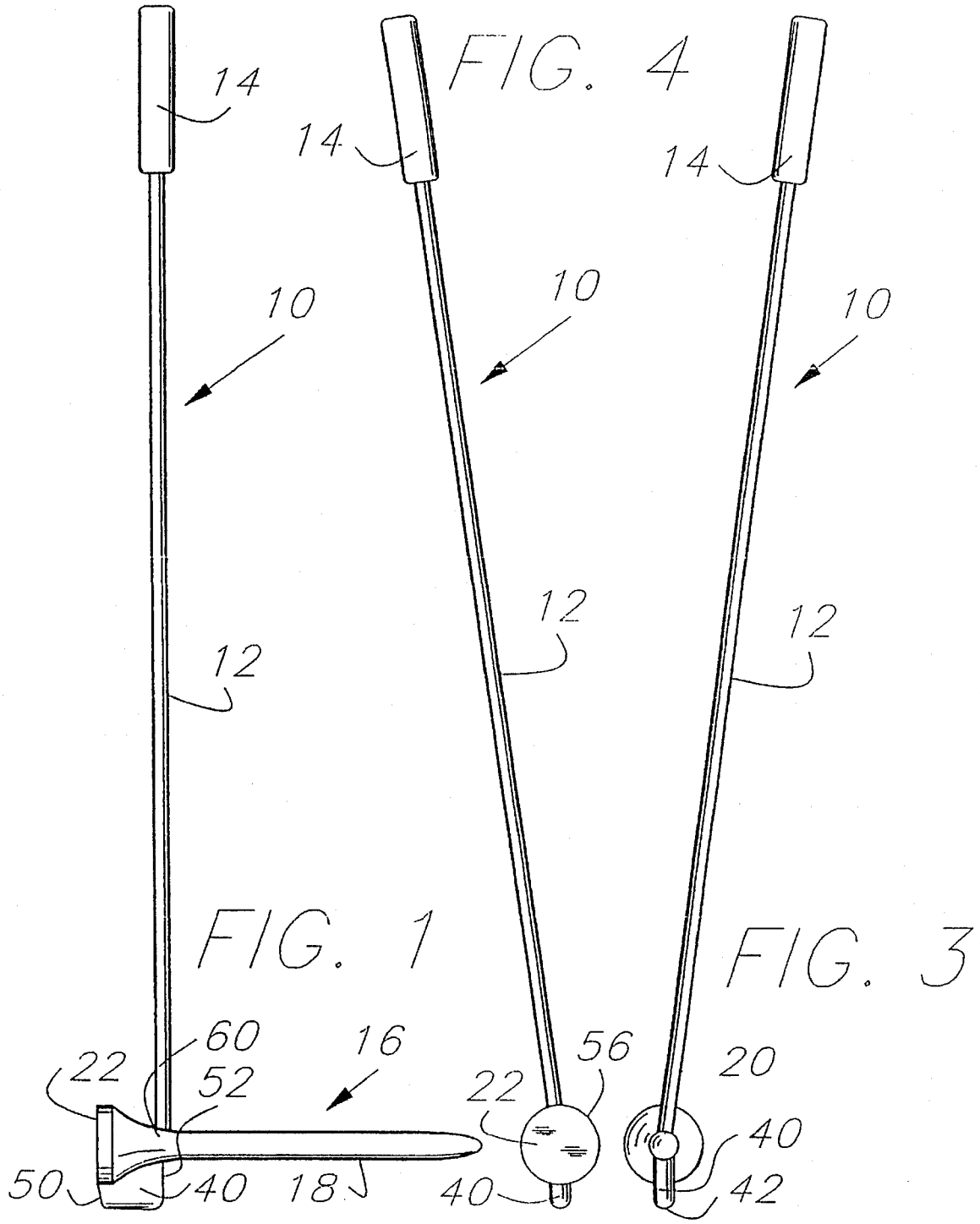
FIG. 1 is an elevational view of a golf putter in accord with the present invention.
FIG. 3 is a rear elevation view of the golf putter of FIG. 1.
FIG. 4 is a front elevational view of the golf putter of FIG. 1.
Figure 2:
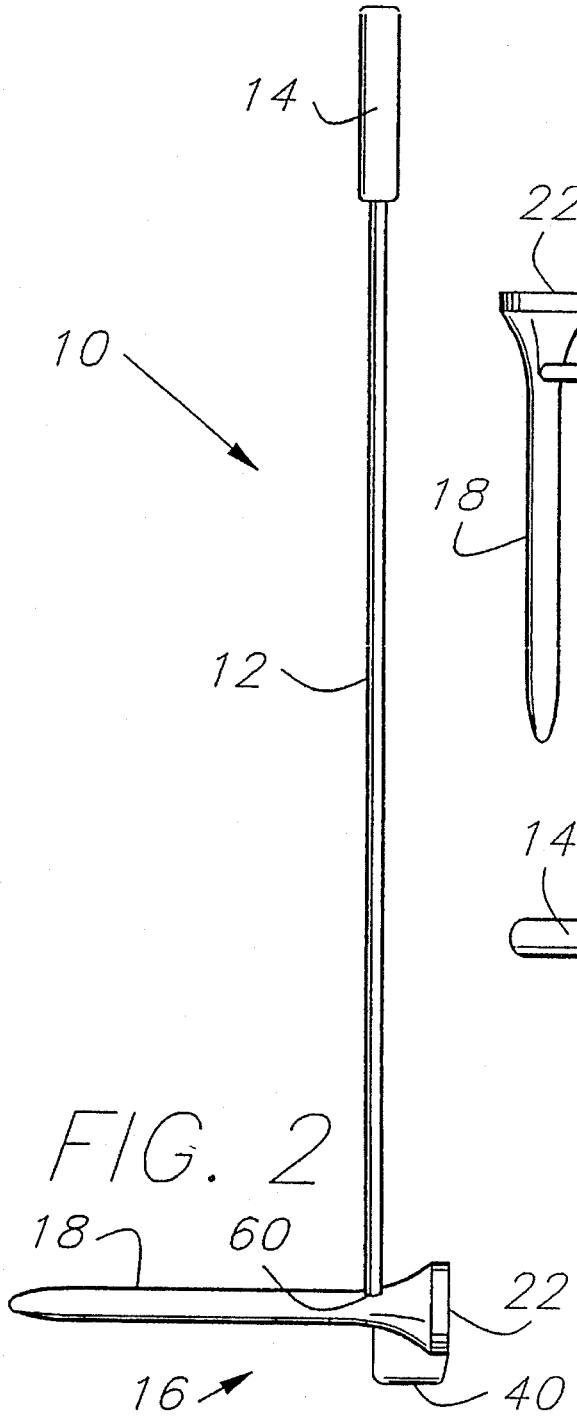
FIG. 2 is an elevational view of the opposite side of the golf putter of FIG. 1.
Figure 5:
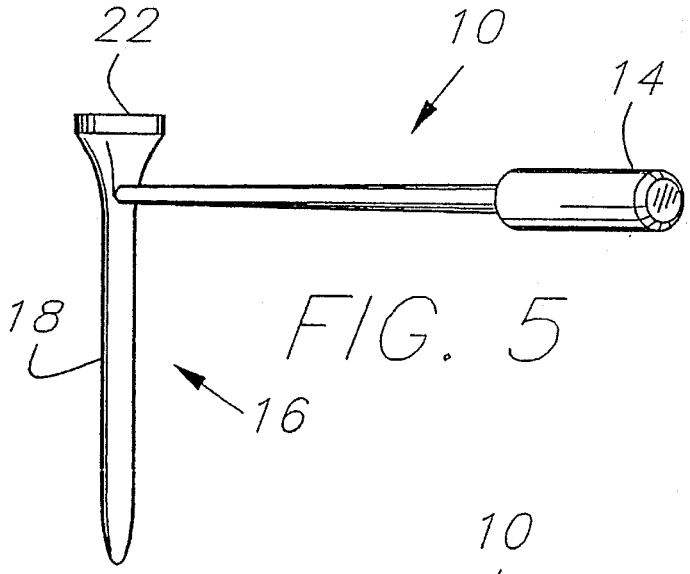
FIG. 5 is a top view of the golf putter of FIG. 1.
Figure 6:
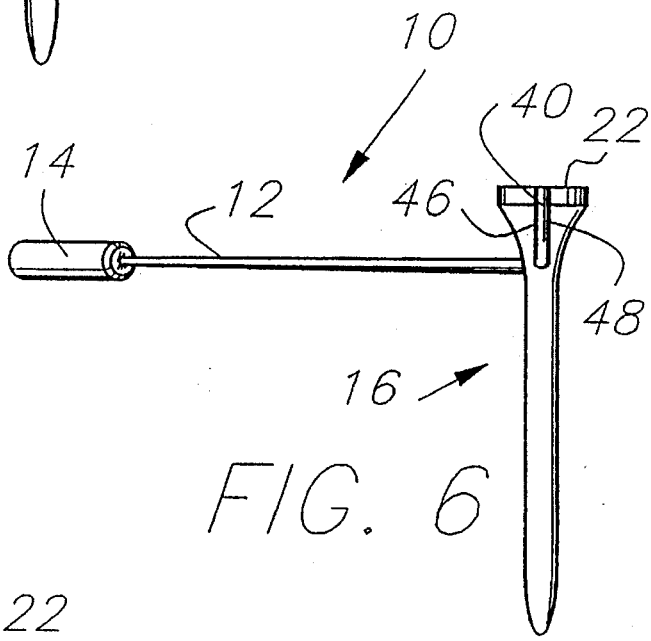
FIG. 6 is a bottom view of the golf putter of FIG. 1.

While the present invention will be described in connection with presently preferred embodiments, it will be understood that it is not intended to limit the invention to those embodiments. On the contrary, it is intended to cover all alternatives, modifications, and equivalents included within the spirit of the invention and as defined in the appended claims.

DETAILED DESCRIPTION OF THE PREFERRED EMBODIMENTS

Referring now to the drawings, and more particularly to FIGS. 1–6, where golf putter 10, in accord with the present invention, is illustrated.

Golf putter 10 includes an elongated, generally tubular shaft 12 that terminates at one end with handle 14. Shaft 12 may be a standard putter shaft and may be of varying lengths selected for suitability to the height or stance of a particular golfer. Handle 14 is preferably a standard putter handle and is selected for comfort with respect to a golfer's desired hand grip.

Figure 9:
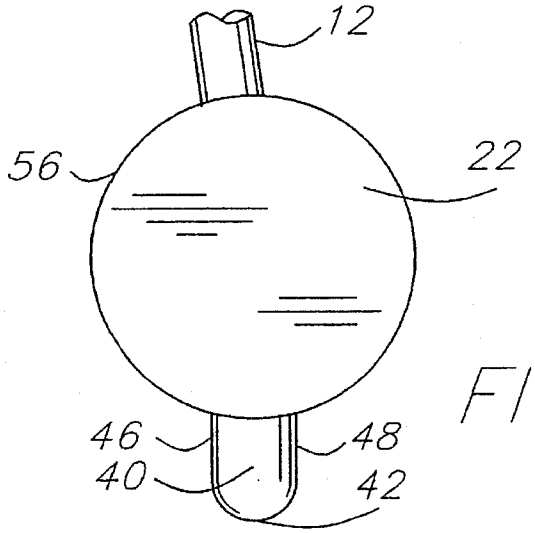
FIG. 9 is a front view of the golf head of FIG. 7.

Opposite from handle 14 on shaft 12, golf head 16 is secured thereto by means that provides for a solid connection. An enlarged view of golf head 16 is provided in FIGS. 7–9. Golf head 16 is preferably shaped in an ornamental manner substantially as though it were a very large golf tee. However, golf head 16 has several distinctive functional features that could be implemented in a manner that would not have the ornamental golf tee appearance.

Golf head 16 includes an elongate body portion 18 with a body axis 19. Body 18 has a substantially bullet-shaped nose 20 and a flat striking face 22 opposite nose 20 and perpendicular to body axis 19. Body 18 preferably has a cylindrical shape 21 over most of its length but could be shaped otherwise in an elongate manner if desired. Body 18 has a bullet taper portion 24 at one end to form bullet-shaped nose 20. At the opposite end from nose 20, body 18 has a radially outwardly taper portion 26 that continues until reaching the diameter of cylindrical portion 28.

Figure 7:
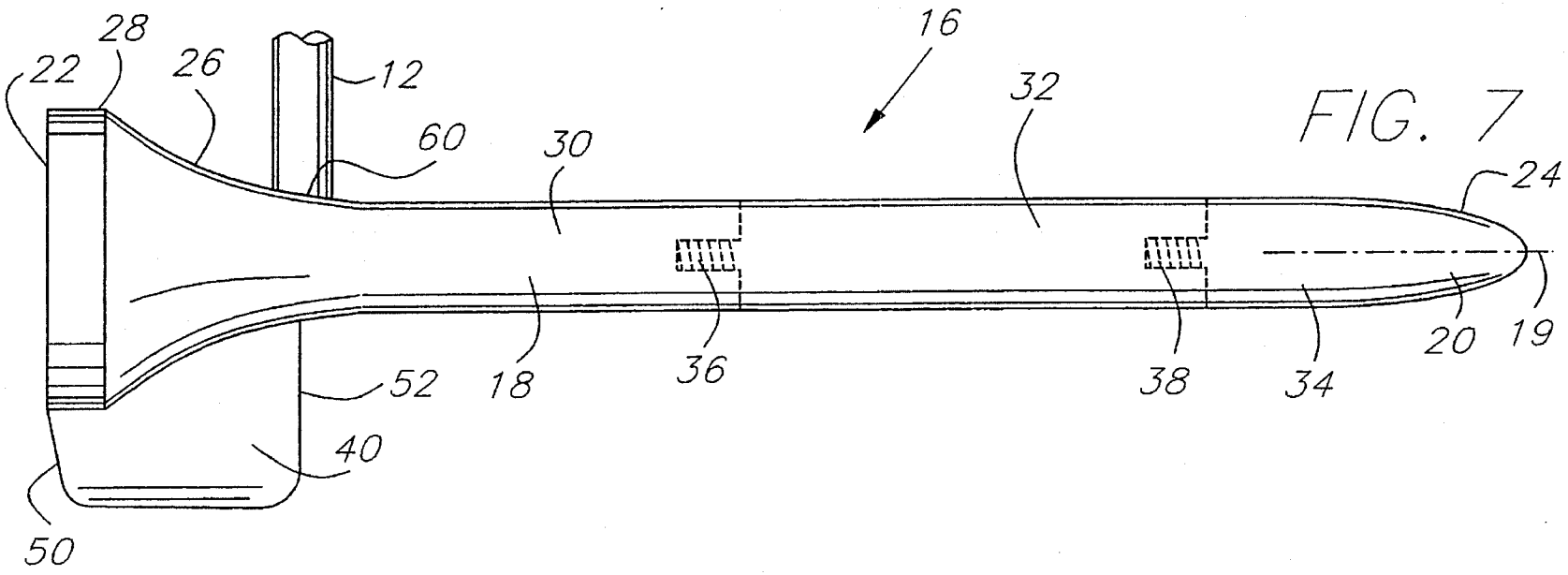
FIG. 7 is an enlarged view, partially in phantom, of a golf head in accord with the present invention.
Figure 8:
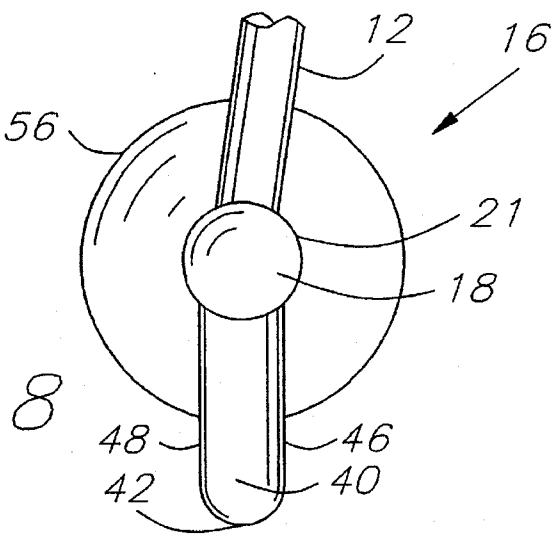
FIG. 8 is a rear view of the golf head of FIG. 7.

Putter head 16 preferably has a fixed weight for putting that, for most golfers, is believed to be best not variable. However, different weighted sections could be used, if desired, to alter the weight of putter head 16. As indicated in FIG. 7, body 18 may be provided in sections, if desired, such as section 30, section 32, and section 34. These sections, if desired, may be threadably secured together as with bolt/thread connections 36 and 38, which connections may be similar to those used with a pool cue. If connections 36 and/or 38 are used, then the connections need to be sturdy and preferably provide a consistently straight structure in line or parallel with axis 19. Different weighted elements for these sections could be used, if desired. As well, the sections may allow for more easily placing golf head 16 into a golf bag for transporting. However, in one presently preferred embodiment of the present invention however, body 18 remains substantially monolithic without separable sections.

While body 18 may have substantially other shapes, it is desirable that body 18 be elongate and perpendicular to striking face 22 as body 18 is used to provide an easily visible aiming or sighting member. The feature of using body 18 as a sight may be easily visualized by referring to FIG. 5 that provides a view looking down the top of body 18 from the same perspective as the golfer may have. To provide adequate sighting body 18 should have a minimum length that, in a preferred embodiment, is at least about three inches. Preferably body 18 is substantially longer so as to be in the range of about nine to fourteen inches. However, body 18 may also be significantly longer in the range of about twenty or more inches.

Along a lower surface of body 18, fin 40 is provided. Fin 40 preferably has a rounded lower surface 42 for engaging putting green 44 (See FIG. 10) preferably in a sliding manner. Lower surface 42 extends from striking face 22 towards nose 20 in a line parallel to body 18 and axis 19 and may preferably stop at a point opposite point 60 about where shaft 12 connects to body 18. Fin 40 may preferably have two planar opposite sides 46 and 48 which are also substantially parallel to body 18 although this is not necessary. Fin 40 has a preferably rounded leading edge 50 and a trailing edge 52.

Figure 10:
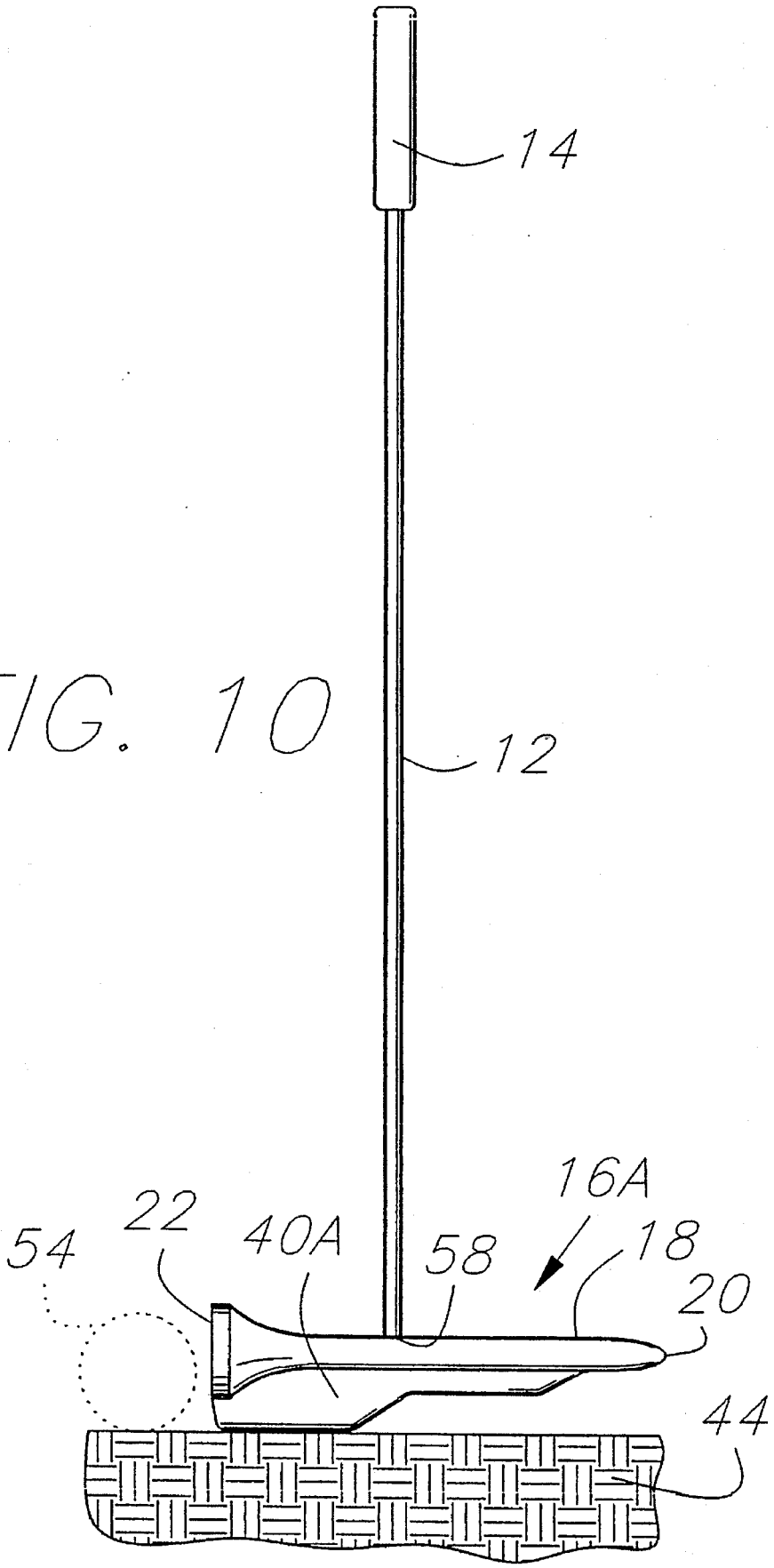
FIG. 10 is an elevational view of another embodiment of the golf putter of the present invention.

Fin 40 has a radially outwardly length with respect to striking face 22 such that when lower surface 42 engages putting green 44, then striking face 22 engages ball 54 at an upwardly position with respect to green 44 such that an overspin is imparted to ball 54 rather than a pushing action that may tend to cause ball 54 to slide rather than roll (see FIG. 10). Generally, this will mean that leading edge 50 extends outwardly of striking face 22 about ¼ to ¾ inches. Trailing edge 52 may typically extend away from body 18 by about one to two inches depending on the diameter of body 18. As best seen in FIG. 3 and FIG. 4, fin 40 is angled with respect to shaft 12 such that the golfer can stand at an offset from the line of movement of golf head 16. The angle between fin 40 and shaft 12 may typically be in the range from about 150° to about 175°.

Striking surface 22 is preferably planar and flat. Striking surface 22 preferably has a rounded or ovular circumference 56 that is preferably larger than the diameter of ball 54. Surface 22 may be varied in size as desired. Thus, with respect to most putters, striking surface 22 is comparatively small. However, striking surface circumference 56 could have other shapes such as rectangular and the like.

In operation, the golfer will typically position golf head 16 behind ball 54 such that striking face 22 may be disposed directly behind ball 54. Elongate body member 18 may be easily sighted or aimed toward the exact direction in which ball 54 is desired to be hit with such calculations including the lay of the putting green, position of the hole, distance to the hole, and so forth. If desired, fin 40 may be moved or slid back and forth in the putting green a few times to produce a path of direction for the putt in the desired direction in line with elongate body member 18. Just prior to hitting ball 54, golf head 16 may be moved behind ball 54 a short distance. Golf head 16 is then moved in a direction aligned with body 18 and axis 19 to make the putt. Fin 40 may be substantially in sliding contact with putting green 44 as desired or not. However, the length of fin 40 provides sufficient offset from the surface of putting green 44 to guarantee that golf ball 54 is hit with an overspin as is desirable for accurate putting. Fin 40 is oriented substantially perpendicular with respect to the surface of putting green 44. Elongate body member 18 will preferably be substantially parallel to the surface of putting green 44 upon hitting and may be held in that position if surface 42 of fin 40 is slid along putting green 44 during the putt.

FIG. 10 provides another embodiment of golf head 16 with an extended fin 40A. As can be appreciated, fin 40A may extend further back towards nose 20 as desired. As well shaft 12, may engage body 18 at engagement point 58 which may be further back along body 18 as compared to engagement point 60 as shown in FIG. 1. A longer fin 40A may be used for sliding smoothly along putting green 44, if desired.

The foregoing disclosure and description of the invention is illustrative and explanatory thereof, and it will appreciated by those skilled in the art, that various changes in the size, shape and materials as well as in the details of the illustrated construction or combinations of features of the golf putter may be made without departing from the spirit of the invention.

What is claimed is:

1. A golf putter, comprising:

a shaft having a hand grip end and a golf head end opposite said hand grip end;

an elongate golf head disposed at said golf head end of said shaft, said elongate golf head having a first end and a second end and a body section with a body axis between said first and second ends, said first end having a striking surface thereon substantially transverse to said body axis, said body section being an elongate rod that acts as a sighting member; and a single fin member only being disposed on said body section on the side of said body section generally opposite that to which the shaft is attached and extending radially outwardly from said body section to provide sufficient offset from a putting surface to guarantee that the golf ball is hit with an overspin.

2. The golf putter of claim 1, wherein:

said single fin member has a leading edge and a trailing edge, said trailing edge being positioned between said first and second ends.

3. The golf putter of claim 2, wherein:

said single fin member has a leading edge and a trailing edge, said leading edge being positioned directly adjacent said striking surface.

4. The golf putter of claim 1, wherein:

said striking surface is circular.

5. The golf putter of claim 1, wherein:

at least a portion of said body section is cylindrical and is substantially centrally disposed with respect to said striking surface.

6. The golf putter of claim 1, wherein:

said single fin member has a leading edge, said radial length of said single fin member along said leading edge that extends outwardly of said striking surface is from ¼ inch to ¾ inches.

7. The golf putter of claim 1, wherein:

said elongate golf head body section includes a tapering surface, said body section coming to a rounded bullet-shaped point at said second end.

8. The golf putter of claim 1, wherein:

said body section of said elongate golf head providing an elongate sighting member disposed between said first and second ends, said elongate golf head having a length ranging from three to about twenty inches long.

9. The golf putter of claim 8, wherein:

said single fin member being positioned circumferentially spaced from said shaft on said elongate golf head such that a surface of said single fin member and said shaft have an angle therebetween ranging from 150° to 175°.

10. The golf putter of claim 9, wherein:

said body section includes a taper region and a cylindrical region, said body section smoothly tapers in diameter between said striking surface and said cylindrical region.

11. A golf putter, comprising:

an elongate shaft having a hand grip end and a golf head end opposite said hand grip end;

an elongate golf head disposed at said golf head end of said elongate shaft, said elongate golf head and said golf head end of said shaft intersecting at a shaft connection, said elongate golf head having a first end and a second end and a body section between said first and second ends, said body section having an elongate body axis, said first end having a striking surface thereon that is substantially transverse to said elongate body axis, said body section including elongate sighting means disposed between said first and second ends ranging from seven to about twenty inches long; and a fin secured to said body section and extending radially outwardly from said body section at a position that is circumferentially offset from said elongate shaft at an angle of from 150° and 175° with respect to said elongate shaft to provide sufficient offset from a putting surface to guarantee that the golf ball is hit with an overspin.

12. The golf putter of claim 11, further comprising:

a cylindrical portion of said body section.

13. The golf putter of claim 11, further comprising:

said fin having a planar surface, said elongate body axis being a straight line and said planar surface containing a portion thereof that is parallel to said elongate body axis.

14. The golf putter of claim 13, wherein said fin further comprises:

a rounded outer leading edge surface and a rounded outer lower edge surface, said lower edge surface being radially spaced from said body section.

15. A method for putting a golf ball, comprising the following steps:

positioning a putter such that a putter striking face is behind said golf ball;

pointing the cylindrical axis of a cylindrical sighting member cooperatively associated with said putter in a desired direction for putting said golf ball;

spacing said putter striking face at a vertical position for imparting overspin upon said golf ball by positioning a single fin member only between said cylindrical sighting member and a putting surface;

moving said single fin member along a ground surface disposed directly behind said golf ball in said desired direction; and hitting said golf ball with said putter striking face.

16. The method of claim 15, further comprising:

disposing said single fin member such that said single fin member extends outwardly from said elongate sighting member at an angle of from 150° and 175° with respect to a putter hand-grip shaft.

17. The method of claim 16, further comprising:

orienting said putter such that said single fin member is oriented substantially perpendicular to said ground surface.

18. The method of claim 16, further comprising:

moving said putter back and forth to provide a path aligned with said elongate sighting member on said ground surface for said single fin member.

19. The method of claim 18, wherein said step of hitting further comprises:

moving said putter such that said single fin member moves along said path prior to said hitting of said golf ball.

* * * * *